US008664924B2

(12) United States Patent
Chen

(10) Patent No.: US 8,664,924 B2
(45) Date of Patent: Mar. 4, 2014

(54) STANDALONE SOLAR ENERGY CONVERSION SYSTEM WITH MAXIMUM POWER POINT TRACING AND METHOD OF OPERATING THE SAME

(75) Inventor: Li-Hsiu Chen, Taoyuan Shien (TW)

(73) Assignee: Delta Electronics, Inc., Taoyuan County (TW)

( * ) Notice: Subject to any disclaimer, the term of this patent is extended or adjusted under 35 U.S.C. 154(b) by 265 days.

(21) Appl. No.: 13/345,026

(22) Filed: Jan. 6, 2012

(65) Prior Publication Data

US 2013/0127435 A1 May 23, 2013

(30) Foreign Application Priority Data

Nov. 22, 2011 (TW) ..... 100142667 A

(51) Int. Cl.
*G05F 1/67* (2006.01)

(52) U.S. Cl.
USPC ..... 323/266; 323/906; 320/101

(58) Field of Classification Search
CPC ..... G05F 1/67
USPC ..... 323/266, 906; 320/101
See application file for complete search history.

(56) References Cited

U.S. PATENT DOCUMENTS 6,081,104 A * 6/2000 Kern ..... 323/268
6,429,621 B1 * 8/2002 Arai ..... 320/101

* cited by examiner

*Primary Examiner* — Harry Behm
(74) *Attorney, Agent, or Firm* — Muncy, Geissler, Olds & Lowe, P.C.

(57) ABSTRACT

A standalone solar energy conversion system includes a first DC-DC conversion apparatus, a second DC-DC conversion apparatus, and a control apparatus. The first DC-DC conversion apparatus receives a DC voltage and converts a voltage level of the DC voltage to provide a capacitance voltage. The second DC-DC conversion apparatus receives the capacitance voltage and converts a voltage level of the capacitance voltage. The control apparatus includes a first comparison unit and a second comparison unit. The capacitance voltage is compared to a first capacitance voltage command and a second capacitance voltage command through the first comparison unit and the second comparison unit, respectively, thus controlling output powers of the first DC-DC conversion apparatus and the second DC-DC conversion apparatus.

10 Claims, 5 Drawing Sheets

STANDALONE SOLAR ENERGY CONVERSION SYSTEM WITH MAXIMUM POWER POINT TRACING AND METHOD OF OPERATING THE SAME

BACKGROUND OF THE INVENTION

1. Field of the Invention

The present invention relates generally to a standalone solar energy conversion system, and more particularly to a standalone solar energy conversion system with maximum power point tracing and method of operating the same.

2. Description of Prior Art

The solar photovoltaic system provides a photovoltaic conversion to generate a DC power through the solar cell panels. Afterward, the DC power is converted into an AC power through a power conditioner to supply to a load or the converted AC power is grid-connected to an AC utility power through the utility grid bus. The solar photovoltaic system can be broadly divided into three categories: (1) stand-alone system, (2) grid-connection system, and (3) hybrid system.

The stand-alone system means that the solar photovoltaic system is completely operational without requiring external support and only directly supply to a load. Hence, the standalone system is generally built in remote areas or isolated islands. In particular, the required power electricity of a load is either the wind power or the solar power. The solar power or/and the wind power can further provide redundant power to charge the standby battery, whereas the load can be supplied through the battery when the solar power or/and the wind power is insufficient. The grid-connection system means that the solar photovoltaic system is further connected to the power grid of the electric power company. Hence, the grid-connection system is suitable for where the utility power can reach. When the amount of electricity generation of the solar photovoltaic system is greater than that of load demands, the redundant power remains would be delivered to the utility grid bus. On the other hand, the utility power can provide the required power electricity to a load when the amount of electricity generation of the solar photovoltaic system is insufficient. Furthermore, in order to improve the power supply reliability and quality, the hybrid system is developed. The solar photovoltaic system, which is combined with standby batteries, is temporarily separated from the utility power to provide power electricity to a load when the utility power fails. The solar photovoltaic system is further grid-connected to the utility grid bus until the utility power is available.

Intensity of sunlight and operating temperature are two important factors of influencing characteristics of the photovoltaic panel. When the photovoltaic panel is operated in a rapidly changing environment, temperature and illumination are changing all the time. Therefore, external loads must be properly controlled in order to achieve the maximum output power of the photovoltaic panel. Otherwise, the photovoltaic panel maybe cannot provide enough energy to the external loads due to changes in environmental conditions, thus causing voltage collapse and abnormal operations. Hence, a maximum power point tracing (MPPT) technology can be adopted to improve the overall efficiency of the solar generation system.

Accordingly, it is desirable to provide a standalone solar energy conversion system with maximum power point tracing and method of operating the same.

SUMMARY OF THE INVENTION

An object of the invention is to provide a standalone solar energy conversion system with maximum power pint tracing to solve the above-mentioned problems.

The standalone solar energy conversion system with maximum power point tracing generates a DC current and a DC voltage through a photovoltaic module and the DC current and the DC voltage are controlled to provide electric power to supply a load. The standalone solar energy conversion system includes a first DC-DC conversion apparatus, a second DC-DC conversion apparatus, and a control apparatus.

The first DC-DC conversion apparatus is electrically connected to the photovoltaic module to receive the DC voltage and convert voltage level of the DC voltage to provide a capacitance voltage. The second DC-DC conversion apparatus is electrically connected to the first DC-DC conversion apparatus to receive the capacitance voltage and convert voltage level of the capacitance voltage to supply the load. The control apparatus is electrically connected to the first DC-DC conversion apparatus and the second DC-DC conversion apparatus.

The control apparatus includes a first comparison unit and a second comparison unit. The first comparison unit receives the capacitance voltage and a first capacitance voltage command for comparing the capacitance voltage with the first capacitance voltage command. The second comparison unit receives the capacitance voltage and a second capacitance voltage command for comparing the capacitance voltage with the second capacitance voltage command. When the first capacitance voltage command is greater than the capacitance voltage, the control apparatus is configured to control the first DC-DC conversion apparatus to increase input energy; when the first capacitance voltage command is less than the capacitance voltage, the control apparatus is configured to control the first DC-DC conversion apparatus to decrease input energy. When the second capacitance voltage command is greater than the capacitance voltage, the control apparatus is configured to control the second DC-DC conversion apparatus to decrease output energy; when the second capacitance voltage command is less than the capacitance voltage, the control apparatus is configured to control the second DC-DC conversion apparatus to increase output energy; wherein the first capacitance voltage command is greater than the second capacitance voltage command.

Another object of the invention is to provide a method of operating a standalone solar energy conversion system with maximum power pint tracing to solve the above-mentioned problems.

The method of operating the standalone solar energy conversion system with maximum power point tracing generating a DC current and a DC voltage through a photovoltaic module, the DC current and the DC voltage controlled to provide electric power to supply a load. Steps of operating the standalone solar energy conversion system includes as follows. (a) a first DC-DC conversion apparatus is provided to receive the DC voltage and convert voltage level of the DC voltage to provide a capacitance voltage; (b) a second DC-DC conversion apparatus is provided to receive the capacitance voltage and convert voltage level of the capacitance voltage to supply the load; (c) a control apparatus, which has a first comparison unit and a second comparison unit, is provided; the first comparison unit receives the capacitance voltage and a first capacitance voltage command for comparing the capacitance voltage with the first capacitance voltage command; the second comparison unit receives the capacitance voltage and a second capacitance voltage command for comparing the capacitance voltage with the second capacitance voltage command; (d) the first DC-DC conversion apparatus is controlled to increase input energy by the control apparatus when the first capacitance voltage command is greater than the capacitance voltage; the first DC-DC conversion apparatus is controlled to decrease input energy by the control apparatus when the first capacitance voltage command is less than the capacitance voltage; and (e) the second DC-DC conversion apparatus is controlled to decrease output energy by the control apparatus when the second capacitance voltage command is greater than the capacitance voltage; the second DC-DC conversion apparatus is controlled to increase output energy by the control apparatus when the second capacitance voltage command is less than the capacitance voltage.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
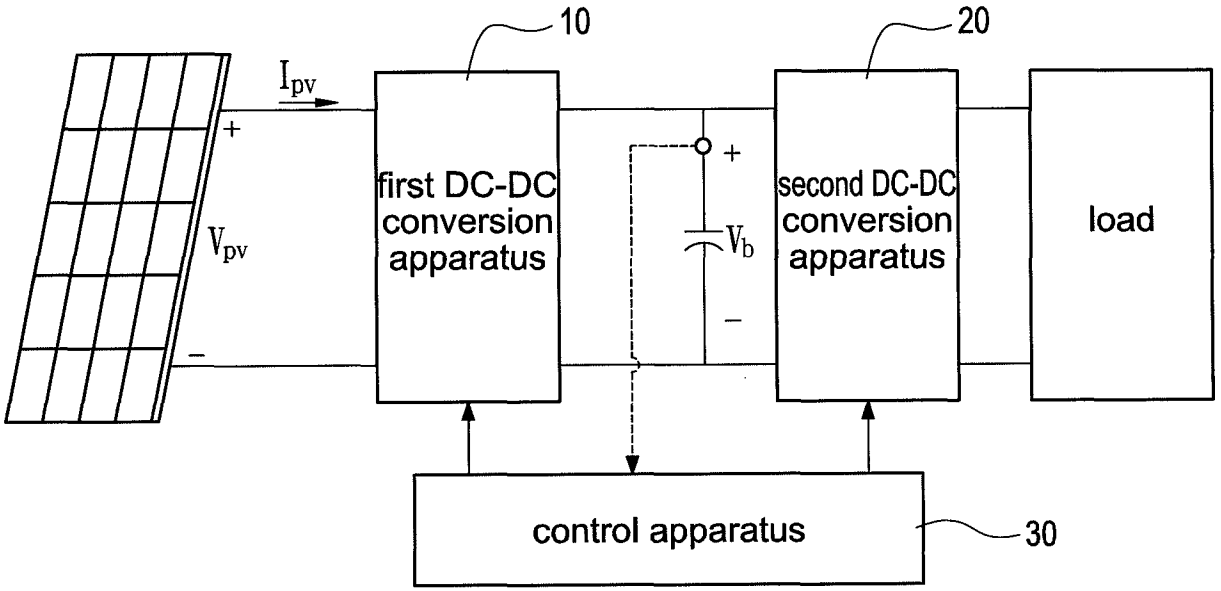
FIG. 1 is a schematic block diagram of a standalone solar energy conversion system with maximum power point tracing according to the present invention.

Reference will now be made to the drawing figures to describe the present invention in detail.

Reference is made to FIG. 1 which is a schematic block diagram of a standalone solar energy conversion system with maximum power point tracing according to the present invention. The standalone solar energy conversion system with maximum power point tracing generates a DC current Ipv and a DC voltage Vpv through a photovoltaic module (not labeled) and the DC current Ipv and the DC voltage Vpv are controlled to provide electric power to supply a load (not labeled). The standalone solar energy conversion system includes a first DC-DC conversion apparatus 10, a second DC-DC conversion apparatus 20, and a control apparatus 30. The first DC-DC conversion apparatus 10 is electrically connected to the photovoltaic module to receive the DC voltage Vpv and convert voltage level of the DC voltage Vpv to provide a capacitance voltage Vb. The second DC-DC conversion apparatus 20 is electrically connected to the first DC-DC conversion apparatus 10 to receive the capacitance voltage Vb and convert voltage level of the capacitance voltage Vb to supply the load. In addition, the standalone solar energy conversion system further includes a buffer capacitor connected between the first DC-DC conversion apparatus 10 and the second DC-DC conversion apparatus 20 to provide an energy buffer between the first DC-DC conversion apparatus 10 and the second DC-DC conversion apparatus 20.

Figure 2:
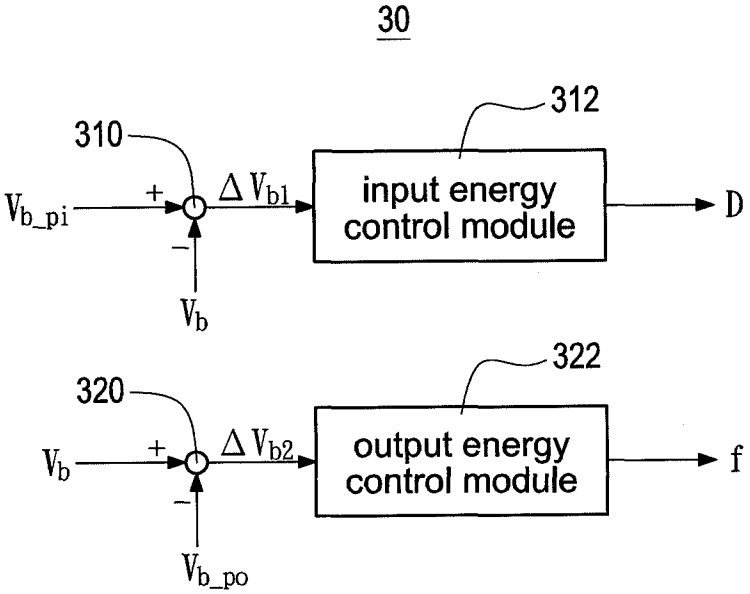
FIG. 2 is a schematic block diagram of a control apparatus of the standalone solar energy conversion system according to the present invention.

Reference is made to FIG. 2 which is a schematic block diagram of a control apparatus of the standalone solar energy conversion system according to the present invention. The control apparatus 30 is electrically connected to the first DC-DC conversion apparatus 10 and the second DC-DC conversion apparatus 20. The control apparatus 30 includes a first comparison unit 310 and a second comparison unit 320. The first comparison unit 310 receives the capacitance voltage Vb and a first capacitance voltage command Vb_pi for comparing the capacitance voltage Vb with the first capacitance voltage command Vb_pi. The second comparison unit 320 receives the capacitance voltage Vb and a second capacitance voltage command Vb_po for comparing the capacitance voltage Vb with the second capacitance voltage command Vb_po. When the first capacitance voltage command Vb_pi is greater than the capacitance voltage Vb (namely, Vb_pi−Vb>0), the control apparatus 30 controls the first DC-DC conversion apparatus 10 to increase input energy. On the other hand, when the first capacitance voltage command Vb_pi is less than the capacitance voltage Vb (namely, Vb_pi−Vb<0), the control apparatus 30 controls the first DC-DC conversion apparatus 10 to decrease input energy. In addition, when the second capacitance voltage command Vb_po is greater than the capacitance voltage Vb (namely, Vb−Vb_po<0), the control apparatus 30 controls the second DC-DC conversion apparatus 20 to decrease output energy. On the other hand, when the second capacitance voltage command Vb_po is less than the capacitance voltage Vb (namely, Vb−Vb_po>0), the control apparatus 30 controls the second DC-DC conversion apparatus 20 to increase output energy. Note that, the first capacitance voltage command Vb_pi is greater than the second capacitance voltage command Vb_po.

Two kinds of relationships between the input energy and the output energy of the standalone solar energy conversion system are as follows: one is that the input energy is greater than the output energy; the other one is that the input energy is less than the output energy. Also, the energy control of the two relationships is implemented according to the capacitance voltage Vb. In brief, the capacitance voltage Vb is greater when the input energy is greater than the output energy. On the other hand, the capacitance voltage Vb is less when the input energy is less than the output energy. Hence, the relationship between the input energy and the output energy of the standalone solar energy conversion system is directly determined by the capacitance voltage Vb.

For the convenience of explanation, with reference back to FIG. 1, the operation of the standalone solar energy conversion system with maximum power point tracing is exemplified according to assumed data. It is assumed that the first capacitance voltage command Vb_pi is 410 volts in a steady state. Also, the second capacitance voltage command Vb_po is 400 volts according to the above-mentioned consideration, that is, the first capacitance voltage command Vb_pi is greater than the second capacitance voltage command Vb_po. Also, a difference between the first capacitance voltage command Vb_pi and the second capacitance voltage command Vb_po is 10 volts. Especially to deserve to be mentioned, the operation of the solar energy conversion system can be divided into three situations according to different values of the capacitance voltage Vb:

Situation 1: The capacitance voltage Vb (300 volts is assumed) is both less than the first capacitance voltage command Vb_pi and the second capacitance voltage command Vb_po, thus, 1. For input energy control: The control apparatus 30 controls the first DC-DC conversion apparatus 10 to increase input energy because the first capacitance voltage command Vb_pi is greater than the capacitance voltage Vb (namely, Vb_pi−Vb=410−300>0, is positive);

2. For output energy control: The control apparatus 30 controls the second DC-DC conversion apparatus 20 to decrease output energy because the second capacitance voltage command Vb_po is greater than the capacitance voltage Vb (namely, Vb−Vb_po=300−400<0, is negative).

Situation 2: The capacitance voltage Vb (405 volts is assumed) is less than the first capacitance voltage command Vb_pi but is greater than the second capacitance voltage command Vb_po, thus, 1. For input energy control: The control apparatus 30 controls the first DC-DC conversion apparatus 10 to increase input energy because the first capacitance voltage command Vb_pi is greater than the capacitance voltage Vb (namely, Vb_pi−Vb=410−405>0, is positive);

2. For output energy control: The control apparatus 30 controls the second DC-DC conversion apparatus 20 to increase output energy because the second capacitance voltage command Vb_po is less than the capacitance voltage Vb (namely, Vb−Vb_po=405−400>0, is positive).

Situation 3: The capacitance voltage Vb (420 volts is assumed) is both greater than the first capacitance voltage command Vb_pi and the second capacitance voltage command Vb_po, thus, 1. For input energy control: The control apparatus 30 controls the first DC-DC conversion apparatus 10 to decrease input energy because the first capacitance voltage command Vb_pi is less than the capacitance voltage Vb (namely, Vb_pi−Vb=410−420<0, is negative);

2. For output energy control: The control apparatus 30 controls the second DC-DC conversion apparatus 20 to increase output energy because the second capacitance voltage command Vb_po is less than the capacitance voltage Vb (namely, Vb−Vb_po=420−400>0, is positive).

In this present invention, the values of the first capacitance voltage command Vb_pi and the second capacitance voltage command Vb_po are set according to topologies of the standalone solar energy conversion system. Also, the first capacitance voltage command Vb_pi is set to be greater than the second capacitance voltage command Vb_po.

When the standalone solar energy conversion system is initially operated, the capacitance voltage Vb is equal to the DC voltage Vpv generated from the photovoltaic module because the first DC-DC conversion apparatus 10 has not yet started. At this time, the capacitance voltage Vb is 300 volts that is equal to the assumed value of the DC voltage Vpv. Afterward, when the first capacitance voltage command Vb_pi is greater than the capacitance voltage Vb (namely, Vb_pi−Vb=410−300>0), the first DC-DC conversion apparatus 10 starts. Hence, the first control signal, such as a duty cycle, is increased by increasing the input energy of the first DC-DC conversion apparatus 10. Note that, a relational expression between the capacitance voltage Vb and the DC voltage Vpv is shown as follows:

$$Vb = \frac{1}{1-D} \times Vpv$$

In this embodiment, the variable D is the first control signal, namely, the duty cycle. Because of the increase of the first control signal, the capacitance voltage Vb is increased. In the same time, for the second DC-DC conversion apparatus 20, the output energy is decreased because the second capacitance voltage command Vb_po is greater than the capacitance voltage Vb (namely, Vb−Vb_po=300-400<0).

Afterward, the input energy of the first DC-DC conversion apparatus 10 continuously increases when the capacitance voltage Vb gradually increases up to 405 volts so that the first capacitance voltage command Vb_pi is still greater than the capacitance voltage Vb (namely, Vb_pi−Vb=410−405>0). At this time, the first control signal of the first DC-DC conversion apparatus 10 is still increased so that the capacitance voltage Vb is also increased. In the same time, for the second DC-DC conversion apparatus 20, the output energy is increased because the second capacitance voltage command Vb_po is less than the capacitance voltage Vb (namely, Vb−Vb_po=405-400>0).

Afterward, the input energy of the first DC-DC conversion apparatus 10 is decreased when the capacitance voltage Vb gradually increases up to 420 volts so that the first capacitance voltage command Vb_pi is less than the capacitance voltage Vb (namely, Vb_pi−Vb=410−420<0). At this time, the first control signal of the first DC-DC conversion apparatus 10 is decreased so that the capacitance voltage Vb is also decreased. In the same time, for the second DC-DC conversion apparatus 20, the output energy is continuously increased because the second capacitance voltage command Vb_po is still less than the capacitance voltage Vb (namely, Vb−Vb_po=420−400>0).

The energy situations of the first DC-DC conversion apparatus 10 and the second DC-DC conversion apparatus 20 can be varied by adjusting the first control signal. However, it is difficult to directly control the first control signal because the first control signal is a nonlinear parameter. Accordingly, the capacitance voltage Vb is directly controlled so as to directly or indirectly control the DC current Ipv and the DC voltage Vpv, thus finally controlling the first control signal. Also, the energy control of input energy and output energy of the standalone solar energy conversion system is determined according to the capacitance voltage Vb.

Figure 3:
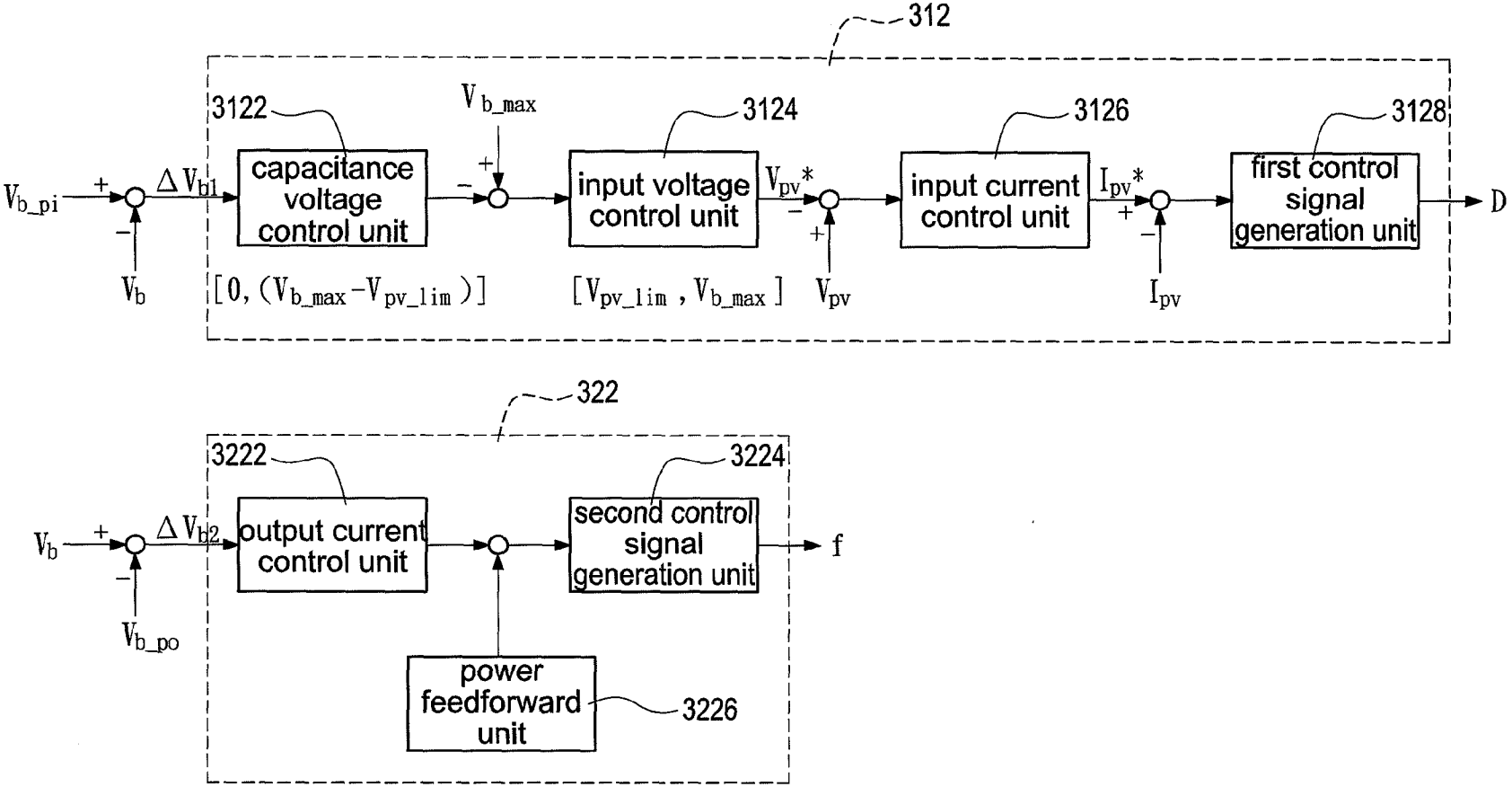
FIG. 3 is another schematic block diagram of the control apparatus according to the present invention.

Reference is made to FIG. 3 which is another schematic block diagram of the control apparatus according to the present invention. The control apparatus 30 further includes an input energy control module 312 and an output energy control module 322. The input energy control module 312 has a capacitance voltage control unit 3122, an input voltage control unit 3124, an input current control unit 3126, and a first control signal generation unit 3128. The capacitance voltage control unit 3122 receives a first voltage difference ΔVb1 between the capacitance voltage Vb and the first capacitance voltage command Vb_pi for controlling the capacitance voltage Vb. Note that, the first voltage difference ΔVb1 is defined as a result of subtracting the capacitance voltage Vb from the first capacitance voltage command Vb_pi. That is, the first voltage difference ΔVb1 is positive when the first capacitance voltage command Vb_pi is greater than the capacitance voltage Vb. On the other hand, the first voltage difference ΔVb1 is negative when the first capacitance voltage command Vb_pi is less than the capacitance voltage Vb. The input voltage control unit 3124 is connected to the capacitance voltage control unit 3122 for controlling the DC voltage Vpv generated from the photovoltaic module. Especially to deserve to be mentioned, a maximum power point tracing (MPPT) scheme is introduced and integrated in the capacitance voltage control unit 3122 and the input voltage control unit 3124. As regards the case of the MPPT scheme, it will be described in detail as follow.

The input current control unit 3126 connected to the input voltage control unit 3124 for controlling the DC current Ipv generated from the photovoltaic module. The first control signal generation unit 3128 is connected to the input current control unit 3126 for controlling a first control signal produced from the first DC-DC conversion apparatus 10.

Furthermore, the output energy control module 322 has an output current control unit 3222, a second control signal generation unit 3224, and a power feedforward unit 3226. The output current control unit 3222 receives a second voltage difference ΔVb2 between the capacitance voltage Vb and the second capacitance voltage command Vb_po for controlling output current of the second DC-DC conversion apparatus 20. The second control signal generation unit 3224 is connected to the output current control unit 3222 for controlling a second control signal of the second DC-DC conversion apparatus 20. The power feedforward unit 3226 is connected to the output current control unit 3222 and the second control signal generation unit 3224 for eliminating power interference due to load variations.

Figure 4:
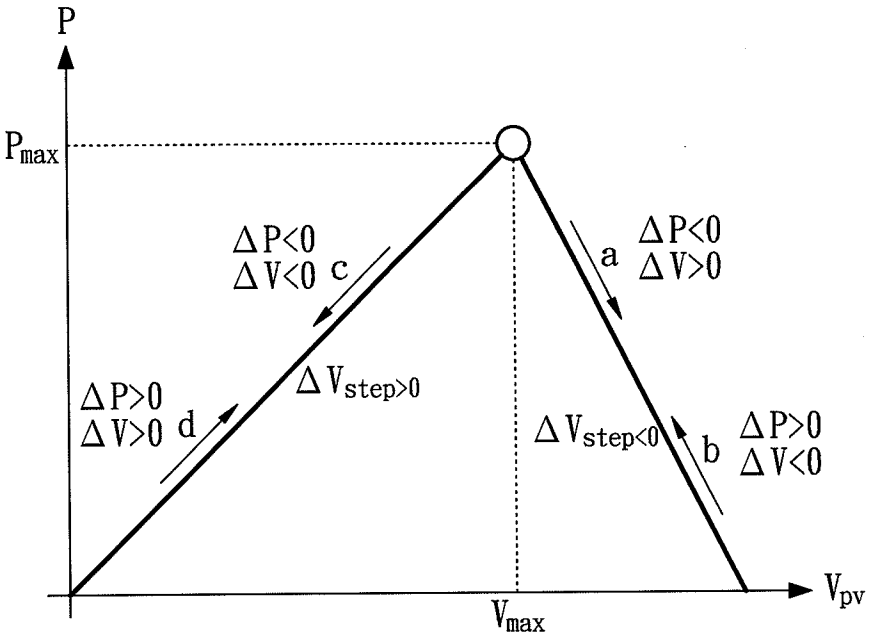
FIG. 4 is a schematic view of a maximum power point tracing (MPPT) according to the present invention.

Furthermore, a maximum power point tracing scheme is introduced into the present invention. Reference is made to FIG. 4 which is a schematic view of a maximum power point tracing (MPPT) according to the present invention. The adopted MPPT method is the well-known perturbation and observation method. In brief, the DC voltage Vpv generated from the photovoltaic module is perturbed and then the output power is observed so that the photovoltaic module can provide the maximum output power Pmax according to the perturbation of the DC voltage Vpv and the observation of the output power. Accordingly, two regions of operating the photovoltaic module are divided as shown in FIG. 4.

Region 1: The operating point is in a right-half region and two operation situations are shown as an "operation a" and an "operation b". The "operation a" expresses a condition of a negative power variation ($\Delta P<0$) and a positive voltage variation ($\Delta V>0$); the "operation b" expresses a condition of a positive power variation ($\Delta P>0$) and a negative voltage variation ($\Delta V<0$). For the perturbation and observation method, the direction of the voltage perturbation occurs toward a maximum voltage Vmax corresponding to the maximum output power Pmax so that a perturbation voltage variation ΔVstep is negative, namely, $\Delta Vstep<0$.

Region 2: The operating point is in a left-half region and two operation situations are shown as an "operation c" and an "operation d". The "operation c" expresses a condition of a negative power variation ($\Delta P<0$) and a negative voltage variation ($\Delta V<0$); the "operation d" expresses a condition of a positive power variation ($\Delta P>0$) and a positive voltage variation ($\Delta V>0$). For the perturbation and observation method, the direction of the voltage perturbation occurs toward a maximum voltage Vmax corresponding to the maximum output power Pmax so that the perturbation voltage variation ΔVstep is positive, namely, $\Delta Vstep>0$.

The capacitance voltage Vb is directly controlled so as to directly or indirectly control the DC current Ipv and the DC voltage Vpv, thus controlling the first control signal. Further, the perturbation and observation method of the maximum power point tracing (MPPT) scheme is adopted. Accordingly, the present invention discloses a standalone solar energy conversion system with maximum power point tracing and a method of operating the same. With reference back to the upper part of FIG. 3, the maximum power point tracing (MPPT) scheme is introduced and integrated in the capacitance voltage control unit 3122 and the input voltage control unit 3124. In which, the Vb_max is the maximum of the capacitance voltage Vb; the Vpv_lim is a voltage of perturbing the DC voltage Vpv and also can be expressed as $Vpv_lim[k]=Vpv_lim[k-1]+\Delta Vstep$. In which, the variable k represents the time parameter.

Figure 5:
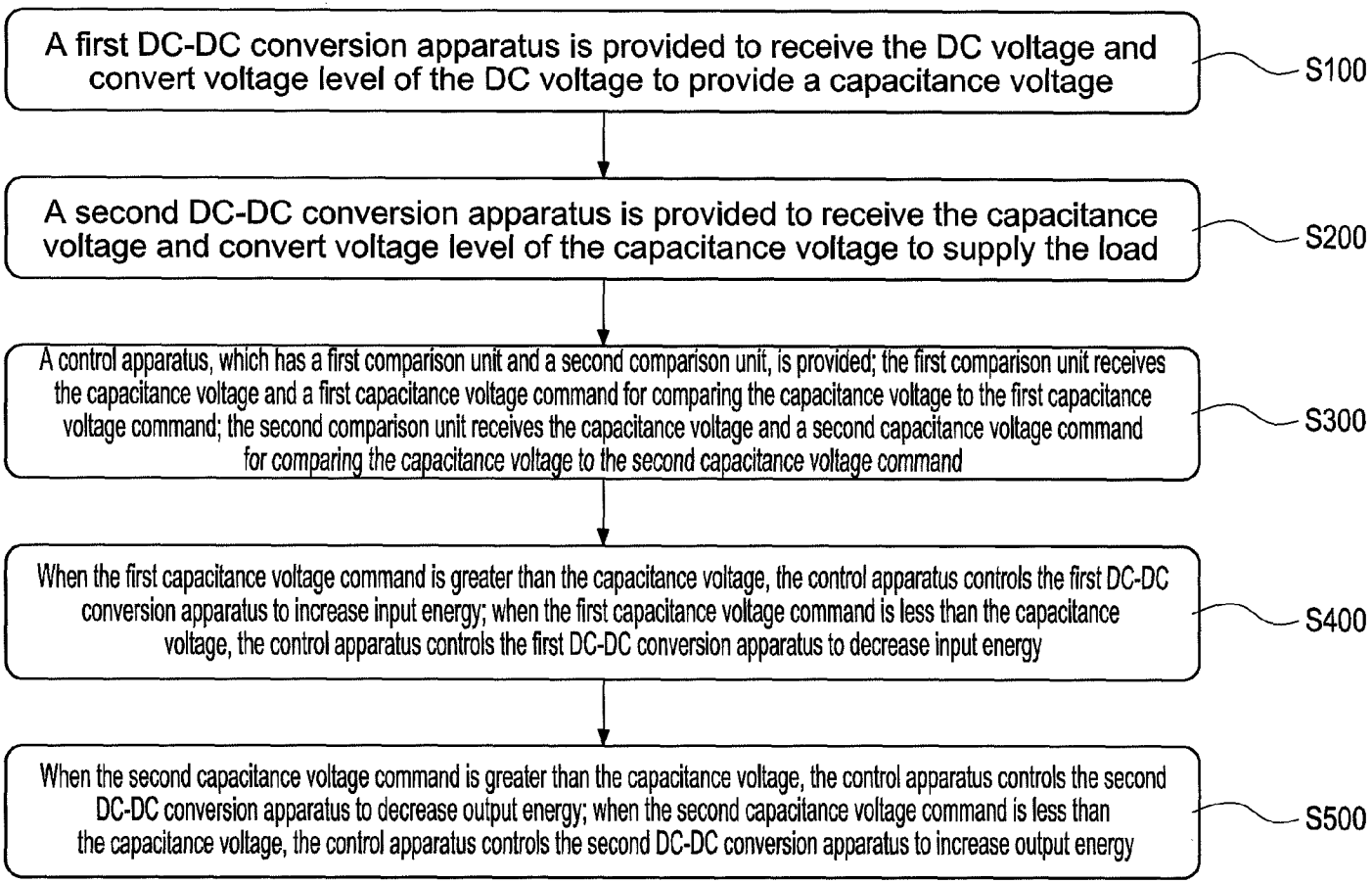
FIG. 5 is a flowchart of a method of operating a standalone solar energy conversion system with maximum power point tracing according to the present invention.

Reference is made to FIG. 5 which is a flowchart of a method of operating a standalone solar energy conversion system with maximum power point tracing according to the present invention. The standalone solar energy conversion system with maximum power point tracing generates a DC current and a DC voltage through a photovoltaic module and the DC current and the DC voltage are controlled to provide electric power to supply a load. The method of operating the standalone solar energy conversion system includes following steps: A first DC-DC conversion apparatus is provided to receive the DC voltage and convert voltage level of the DC voltage to provide a capacitance voltage (S100). A second DC-DC conversion apparatus is provided to receive the capacitance voltage and convert voltage level of the capacitance voltage to supply the load (S200). A control apparatus, which has a first comparison unit and a second comparison unit, is provided; the first comparison unit receives the capacitance voltage and a first capacitance voltage command for comparing the capacitance voltage with the first capacitance voltage command; the second comparison unit receives the capacitance voltage and a second capacitance voltage command for comparing the capacitance voltage with the second capacitance voltage command (S300). Note that, the first capacitance voltage command is greater than the second capacitance voltage command, and more particularly to a 10-volt voltage difference between the first capacitance voltage command and the second capacitance voltage command is a preferred embodiment. In addition, the control apparatus further includes an input energy control module and an output energy control module. The input energy control module is connected to the first comparison unit to receive a voltage difference between the capacitance voltage and the first capacitance voltage command to produce a first control signal for controlling the first DC-DC conversion apparatus. The output energy control module is connected to the second comparison unit to receive a voltage difference between the capacitance voltage and the second capacitance voltage command to produce a second control signal for controlling the second DC-DC conversion apparatus.

Note that, the input energy control module has a capacitance voltage control unit, an input voltage control unit, an input current control unit, and a first control signal generation unit. The capacitance voltage control unit receives the voltage difference between the capacitance voltage and the first capacitance voltage command for controlling the capacitance voltage. The input voltage control unit is connected to the capacitance voltage control unit for controlling the DC voltage generated from the photovoltaic module. The input current control unit is connected to the input voltage control unit for controlling the DC current generated from the photovoltaic module. The first control signal generation unit is connected to the input current control unit for controlling the first DC-DC conversion apparatus. In addition, the output energy control module has an output current control unit and a second control signal generation unit. The output current control unit receives the voltage difference between the capacitance voltage and the second capacitance voltage command for controlling output current of the second DC-DC conversion apparatus. The second control signal generation unit is connected to the output current control unit for controlling the second DC-DC conversion apparatus. In addition, the perturbation and observation method of the maximum power point tracing (MPPT) scheme is provided by the control apparatus.

When the first capacitance voltage command is greater than the capacitance voltage, the control apparatus controls the first DC-DC conversion apparatus to increase input energy. On the other hand, when the first capacitance voltage command is less than the capacitance voltage, the control apparatus controls the first DC-DC conversion apparatus to decrease input energy (S400). When the second capacitance voltage command is greater than the capacitance voltage, the control apparatus controls the second DC-DC conversion apparatus to decrease output energy. On the other hand, when the second capacitance voltage command is less than the capacitance voltage, the control apparatus controls the second DC-DC conversion apparatus to increase output energy (S500). The energy situations of the first DC-DC conversion apparatus and the second DC-DC conversion apparatus can be varied by adjusting the first control signal. However, it is difficult to directly control the first control signal because the first control signal is a nonlinear parameter. Accordingly, the capacitance voltage is directly controlled so as to directly or indirectly control the DC current and the DC voltage, thus finally controlling the first control signal. Also, the energy control of input energy and output energy of the standalone solar energy conversion system is determined according to the capacitance voltage.

In conclusion, the present invention has following advantages:

1. The relationship between the input energy and the output energy of the standalone solar energy conversion system is directly determined according to the relationship of the capacitance voltage and the capacitance voltage commands. Hence, the capacitance voltage is directly controlled to directly or indirectly control the DC current and the DC voltage and finally control the first control signal instead of directly controlling the first control signal; and 2. The maximum power point tracing (MPPT) scheme is adopted to increase the overall generation efficiency of the standalone solar energy conversion system.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A standalone solar energy conversion system with maximum power point tracing, the standalone solar energy conversion system generating a DC current and a DC voltage through a photovoltaic module, the DC current and the DC voltage controlled to provide electric power to supply a load; the standalone solar energy conversion system comprising:

a first DC-DC conversion apparatus electrically connected to the photovoltaic module to receive the DC voltage and convert voltage level of the DC voltage to provide a capacitance voltage;

a second DC-DC conversion apparatus electrically connected to the first DC-DC conversion apparatus to receive the capacitance voltage and convert voltage level of the capacitance voltage to supply the load; and a control apparatus electrically connected to the first DC-DC conversion apparatus and the second DC-DC conversion apparatus, the control apparatus comprising:

a first comparison unit receiving the capacitance voltage and a first capacitance voltage command for comparing the capacitance voltage with the first capacitance voltage command; and a second comparison unit receiving the capacitance voltage and a second capacitance voltage command for comparing the capacitance voltage with the second capacitance voltage command;

when the first capacitance voltage command is greater than the capacitance voltage, the control apparatus is configured to control the first DC-DC conversion apparatus to increase input energy;

when the first capacitance voltage command is less than the capacitance voltage, the control apparatus is configured to control the first DC-DC conversion apparatus to decrease input energy;

when the second capacitance voltage command is greater than the capacitance voltage, the control apparatus is configured to control the second DC-DC conversion apparatus to decrease output energy; and when the second capacitance voltage command is less than the capacitance voltage, the control apparatus is configured to control the second DC-DC conversion apparatus to increase output energy; wherein the first capacitance voltage command is greater than the second capacitance voltage command.

2. The standalone solar energy conversion system of claim 1, wherein the control apparatus further comprises:

an input energy control module connected to the first comparison unit to receive a voltage difference between the capacitance voltage and the first capacitance voltage command to produce a first control signal for controlling the first DC-DC conversion apparatus; and an output energy control module connected to the second comparison unit to receive a voltage difference between the capacitance voltage and the second capacitance voltage command to produce a second control signal for controlling the second DC-DC conversion apparatus.

3. The standalone solar energy conversion system of claim 2, wherein the input energy control module comprises:

a capacitance voltage control unit receiving the voltage difference between the capacitance voltage and the first capacitance voltage command for controlling the capacitance voltage;

an input voltage control unit connected to the capacitance voltage control unit for controlling the DC voltage generated from the photovoltaic module;

an input current control unit connected to the input voltage control unit for controlling the DC current generated from the photovoltaic module; and a first control signal generation unit connected to the input current control unit for controlling the first DC-DC conversion apparatus.

4. The standalone solar energy conversion system of claim 2, wherein the output energy control module comprises:

an output current control unit receiving the voltage difference between the capacitance voltage and the second capacitance voltage command for controlling output current of the second DC-DC conversion apparatus; and a second control signal generation unit connected to the output current control unit for controlling the second DC-DC conversion apparatus.

5. The standalone solar energy conversion system of claim 4, wherein the output energy control module further comprises:

a power feedforward unit connected to the output current control unit and the second control signal generation unit for eliminating power interference due to load variations.

6. The standalone solar energy conversion system of claim 1, the standalone solar energy conversion system further comprising:

a buffer capacitor electrically connected between the first DC-DC conversion apparatus and the second DC-DC conversion apparatus to provide an energy buffer between the first DC-DC conversion apparatus and the second DC-DC conversion apparatus.

7. A method of operating a standalone solar energy conversion system with maximum power point tracing generating a DC current and a DC voltage through a photovoltaic module, the DC current and the DC voltage controlled to provide electric power to supply a load; steps of operating the standalone solar energy conversion system comprising:

(a) providing a first DC-DC conversion apparatus to receive the DC voltage and convert voltage level of the DC voltage to provide a capacitance voltage;

(b) providing a second DC-DC conversion apparatus to receive the capacitance voltage and convert voltage level of the capacitance voltage to supply the load;

(c) providing a control apparatus having a first comparison unit and a second comparison unit; the first comparison unit receiving the capacitance voltage and a first capacitance voltage command for comparing the capacitance voltage with the first capacitance voltage command; the second comparison unit receiving the capacitance voltage and a second capacitance voltage command for comparing the capacitance voltage with the second capacitance voltage command;

(d) controlling the first DC-DC conversion apparatus to increase input energy by the control apparatus when the first capacitance voltage command is greater than the capacitance voltage; controlling the first DC-DC conversion apparatus to decrease input energy by the control apparatus when the first capacitance voltage command is less than the capacitance voltage; and (e) controlling the second DC-DC conversion apparatus to decrease output energy by the control apparatus when the second capacitance voltage command is greater than the capacitance voltage; controlling the second DC-DC conversion apparatus to increase output energy by the control apparatus when the second capacitance voltage command is less than the capacitance voltage.

8. The method of operating the standalone solar energy conversion system of claim 7, wherein the control apparatus further comprises:

an input energy control module connected to the first comparison unit to receive a voltage difference between the capacitance voltage and the first capacitance voltage command to produce a first control signal for controlling the first DC-DC conversion apparatus; and an output energy control module connected to the second comparison unit to receive a voltage difference between the capacitance voltage and the second capacitance voltage command to produce a second control signal for controlling the second DC-DC conversion apparatus.

9. The method of operating the standalone solar energy conversion system of claim 8, wherein the input energy control module comprises:

a capacitance voltage control unit receiving the voltage difference between the capacitance voltage and the first capacitance voltage command for controlling the capacitance voltage;

an input voltage control unit connected to the capacitance voltage control unit for controlling the DC voltage generated from the photovoltaic module;

an input current control unit connected to the input voltage control unit for controlling the DC current generated from the photovoltaic module; and a first control signal generation unit connected to the input current control unit for controlling the first DC-DC conversion apparatus.

10. The method of operating the standalone solar energy conversion system of claim 8, wherein the output energy control module comprises:

an output current control unit receiving the voltage difference between the capacitance voltage and the second capacitance voltage command for controlling output current of the second DC-DC conversion apparatus; and a second control signal generation unit connected to the output current control unit for controlling the second DC-DC conversion apparatus.

* * * * *